United States Patent [19]

Price

[11] 3,965,955

[45] June 29, 1976

[54] GOLF CLUB HEAD COVERS

[75] Inventor: Edward John Price, Dunsley, England

[73] Assignee: Colgate-Palmolive Company, New York, N.Y.

[22] Filed: May 21, 1975

[21] Appl. No.: 579,539

[52] U.S. Cl. ..... 150/52 G
[51] Int. Cl.[2] ..... A63B 57/00
[58] Field of Search ..... 150/52 G

[56] References Cited

UNITED STATES PATENTS

| | | | |
|---|---|---|---|
| 3,023,795 | 3/1962 | Denkert | 150/52 G |
| 3,295,236 | 1/1967 | Wishnia | 150/52 G |
| 3,303,865 | 2/1967 | Ouimet | 150/52 G |

*Primary Examiner*—Donald F. Norton
*Attorney, Agent, or Firm*—Herbert S. Sylvester; Murray M. Grill; Kenneth A. Koch

[57] ABSTRACT

A golf club head cover having a three ply wall construction of a water impervious outer layer, non-moisture absorbent textile material inner liner and an intermediate foam plastic layer.

3 Claims, 3 Drawing Figures

GOLF CLUB HEAD COVERS

This invention relates to covers for golf club heads, particularly wooden heads.

According to the invention a golf club head cover is made of an outer layer of material impervious or substantially impervious to water and a lining of a soft substantially non-absorbent textile material.

In conventional covers the lining is made of a soft textile material, usually a raised cotton material, in order to protect the finish on the club head. Such lining materials, however, tend to absorb moisture. When damp, such materials have a high coefficient of friction and exert a noticeable drag when the cover is being removed and replaced. Also, because such linings retain moisture they may in time have a deleterious effect on the club head finish, for example when clubs are frequently put away damp in a locker. By using for the lining a substantially non-absorbent soft textile material these disadvantages are obviated.

A suitable material for the lining is a woven or knitted fabric consisting wholly or mainly of a substantially non-absorbent textile fiber such as nylon. The material may be proofed to increase its moisture resistance.

In a preferred form of the invention there is an intermediate layer of flexible foam plastics material. Preferably this is conjoined with the lining material, e.g. as a so-called "foam-back". Not only does this improve the "body" of the club head cover but it has a further advantage. In a conventional club head cover, owing to the aforementioned drag of a damp conventional lining it is usual for the lining to be secured to the outer layer at the top or inner end of the cover so that the lining does not pull out of the cover when the cover is being removed from the club head. When a foam intermediate layer is provided, in accordance with the said preferred form of the invention, the frictional grip of that layer on the outer layer is, in general, greater than the frictional drag of the lining on the club head. Thus there is no tendency for the lining to pull out of the cover when the cover is being removed from the club head. Consequently there is no need to secure the inner end or top of the lining to the cover, which enables the manufacture of the cover to be simplified.

A further advantage of the foam-backed substantially non-absorbent lining material is that the lining allows freer circulation of air around the club head, to facilitate drying off.

Figure 1:
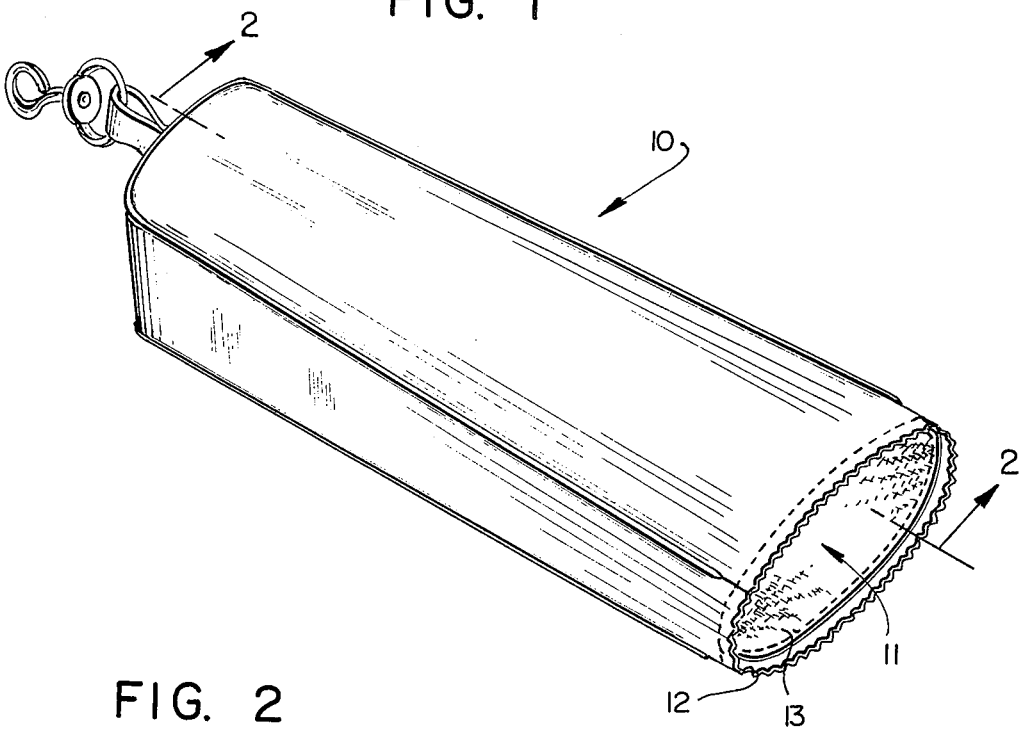
Figure 2:
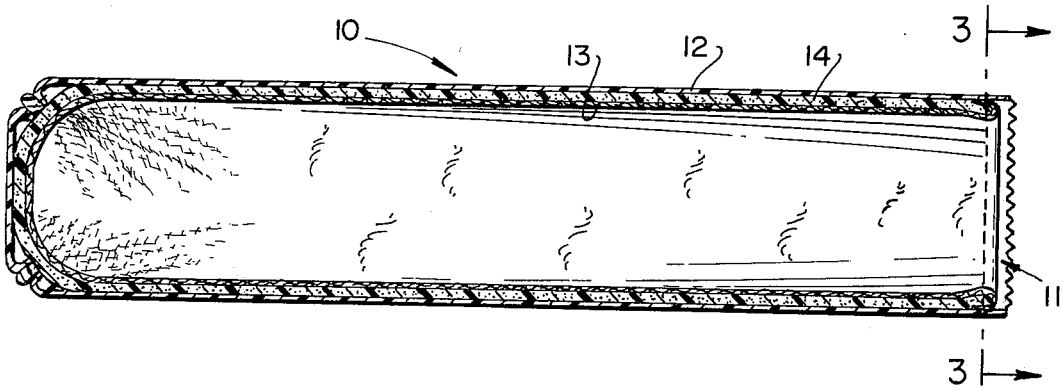
Figure 3:
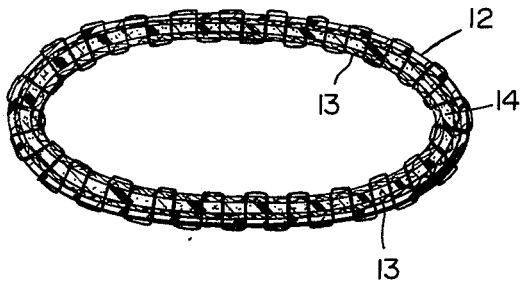

A preferred embodiment of the invention is shown in the accompanying drawing wherein FIG. 1 is a perspective view of a golf head cover FIG. 2 is a longitudinal cross section view of the head cover of FIG. 1 taken along line 2—2 of FIG. 1 and FIG. 3 is a cross sectional view of the head cover taken along line 3—3 of FIG. 1.

Referring to the drawing a golf head cover 10 in the shape of an elongated receptacle having an open end 11 for receiving a golf club head (not shown) and a three ply wall structure is shown. The wall structure includes an outer layer 12, an inner liner 13 and an intermediate layer 14.

The outer layer 12 may be made of any suitable material that is impervious or substantially impervious to water, such as any of such materials employed for the outer layers of conventional golf head covers of the type well known in the art. It is preferred to use an expanded vinyl plastic such as that available from Imperial Chemical Industries under the trademarke AMBLA for the outer layer.

The inner liner 13 can be a soft non-moisture absorbent textile material. Preferably the inner liner is a woven or knitted fabric of nylon textile fibers.

The intermediate layer 14 can be a foamed plastic chosen from the many well known in the art. A polyester foam having a thickness of about 2 millimeters is preferred.

According to the invention the inner liner 13 can be joined to the intermediate layer to form a foam backed fabric. The joinder of the inner liner 13 to the intermediate layer 14 can be by adhesives, heat sealing or any other suitable method known in the art.

In further accordance with the invention, the inner liner 13 and intermediate layer 14 are joined to the outer layer 12 only at the one end 11 of the receptacle. The inner liner and intermediate layer are preferably attached to the outer layer by stitching 15.

The invention has been described in terms of a preferred embodiment to which various equivalent modifications may be made. Accordingly, reference should be made to the appended claims to determine the scope of the invention.

I claim:

1. A golf club head cover comprising an elongated receptacle having an open end for receiving a golf club head, said receptacle being defined by at least a three ply wall including an outer layer of a material substantially impervious to water, an inner liner of a soft non-moisture absorbent textile material and an intermediate layer of a flexible foam plastic material, said inner liner and said intermediate layer being conjoined, said inner liner and said intermediate layer being free from attachment to said outer layer except at said open end.

2. The head cover of claim 1 wherein said inner liner comprises nylon fibers.

3. The head cover of claim 1 wherein the frictional grip of the intermediate layer on the outer layer is greater than the frictional grip of the inner liner on a golf club head.

* * * * *